United States Patent [19]

Snyder

[11] Patent Number: 4,923,105

[45] Date of Patent: May 8, 1990

[54] UTILITY BELT

[76] Inventor: James M. Snyder, P.O. Box 1178, Summerland, Calif. 93067

[21] Appl. No.: 229,847

[22] Filed: Aug. 8, 1988

[51] Int. Cl.[5] ..... A45F 3/04

[52] U.S. Cl. ..... 224/255; 224/216; 224/227; 224/228; 224/232; 224/240; 224/252; 224/253; 224/259; 224/264; 224/901; 224/904

[58] Field of Search ..... 224/901, 904, 191, 201, 224/202, 204, 208, 209, 214, 215, 216, 222, 223, 224, 226, 227, 228, 231, 232, 240, 251, 252, 253, 255, 257, 258, 259, 264; 383/119, 117, 109

[56] References Cited

U.S. PATENT DOCUMENTS

| | | | |
|---|---|---|---|
| Re. 1,692 | 6/1864 | Mann | 224/232 |
| 770,761 | 9/1904 | Lemly | 224/216 |
| 1,600,027 | 9/1926 | Welsand | 224/223 |
| 2,626,092 | 1/1953 | Rose | 224/232 |
| 3,212,690 | 10/1965 | Green | 224/904 X |
| 3,401,857 | 9/1968 | Wilson et al. | 224/214 |
| 3,599,847 | 8/1971 | Danielson | 224/253 |
| 3,664,560 | 5/1972 | Perkins | 224/253 |
| 3,884,403 | 5/1975 | Brewer | 224/204 |
| 3,948,436 | 4/1976 | Bambara | 383/119 X |
| 4,047,650 | 9/1977 | Domingos | 224/232 |
| 4,136,205 | 1/1979 | Quattlebaum | 383/119 X |
| 4,264,659 | 4/1981 | Pattenden | 383/119 X |
| 4,431,041 | 2/1984 | Leiserson | 224/901 X |
| 4,461,411 | 7/1984 | Harrow | 224/208 |
| 4,485,947 | 12/1984 | Cook | 224/243 |
| 4,515,300 | 5/1985 | Cohen | 224/253 |
| 4,600,134 | 7/1986 | Colby | 224/264 X |
| 4,638,530 | 1/1987 | Perry | 24/3 L |
| 4,645,104 | 2/1987 | Vokaty | 224/253 |
| 4,676,419 | 6/1987 | Victor | 224/252 |
| 4,690,316 | 9/1987 | Peterson | 224/253 |
| 4,747,527 | 5/1988 | Trumpower, II | 224/224 |
| 4,805,819 | 2/1989 | Collins | 224/232 |

FOREIGN PATENT DOCUMENTS

| | | | |
|---|---|---|---|
| 1068240 | 12/1979 | Canada . | |
| 436322 | 3/1912 | France | 224/216 |
| 975535 | 3/1951 | France . | |
| 35 | of 1890 | United Kingdom | 224/216 |
| 627 | of 1915 | United Kingdom | 224/264 |

*Primary Examiner*—Ernest G. Cusick

*Attorney, Agent, or Firm*—Woodard, Emhardt, Naughton, Moriarty & McNett

[57] ABSTRACT

In one embodiment, a utility belt comprises a belt adapted to be worn around the waist of a wearer, and a number of belt components removably mounted on the belt. Included among the number of belt components is a flexible pouch arrangement with a number of expandable pockets having a puncture resistant interior surface. The flexible pouch arrangement can be composed of a fabric, such as a nylon mesh, coated with a puncture resistant material, such as poly-vinyl chloride, that has sufficient stiffness to retain the shape of the pouch arrangement. The flexible pouch arrangement can also include a first pocket having an outer wall and a pair of loops affixed to the wall. A detachable pocket includes a pair of pressure adherent, or Velcro, strips corresponding to the pair of loops. The detachable pocket can be removably mounted on the first pocket by engaging the Velcro strips about a corresponding one of the loops.

7 Claims, 3 Drawing Sheets

UTILITY BELT

BACKGROUND OF THE INVENTION

The present invention relates to the field of utility belts, such as are worn by carpenters, electricians, and other journeymen laborers. In particular, the present invention relates to improvements in the construction of pockets and other components carried by the utility belt and to improvements in a harness for supporting the utility belt.

SUMMARY OF THE INVENTION

In one embodiment of the present invention, a utility belt comprises a belt adapted to be worn around the waist of a wearer, and a number of belt components removably mounted on the belt. Included among the number of belt components is a flexible pouch arrangement with a number of expandable pockets having a puncture resistant interior surface. The flexible pouch arrangement can be composed of a fabric, such as a nylon mesh, coated with a puncture resistant material, such as poly-vinyl chloride, that has sufficient stiffness to retain the shape of the pouch arrangement.

The flexible pouch arrangement can also include a first pocket having an outer wall and a loop arrangement on the wall. This embodiment includes a detachable pocket having a pressure adherent strip arrangement corresponding to the loop arrangement, engaged about the loop arrangement for removable attachment of the detachable pocket to the first pocket.

In another embodiment, the utility belt includes a belt adapted to be worn around the waist of a wearer, with a number of belt components removably mounted on the belt. A harness, adapted to be worn around the torso of the wearer, is included for supporting the belt. The harness includes a buckle situated adjacent the back of the wearer when the harness is worn about the torso of the wearer, with a continuous shoulder strap slidably extending through the buckle and a continuous lower back strap slidably extending through the buckle. A disconnectable sternum strap is affixed between the left and right free ends of the shoulder strap, arranged to be worn across the chest of the wearer when the harness is around the torso of the wearer. The harness is removably attached to the to the belt by way of a pair of disconnectable latch assemblies through which the free ends of the shoulder strap are adjustably threaded.

DESCRIPTION OF THE PREFERRED EMBODIMENTS

Figure 1:
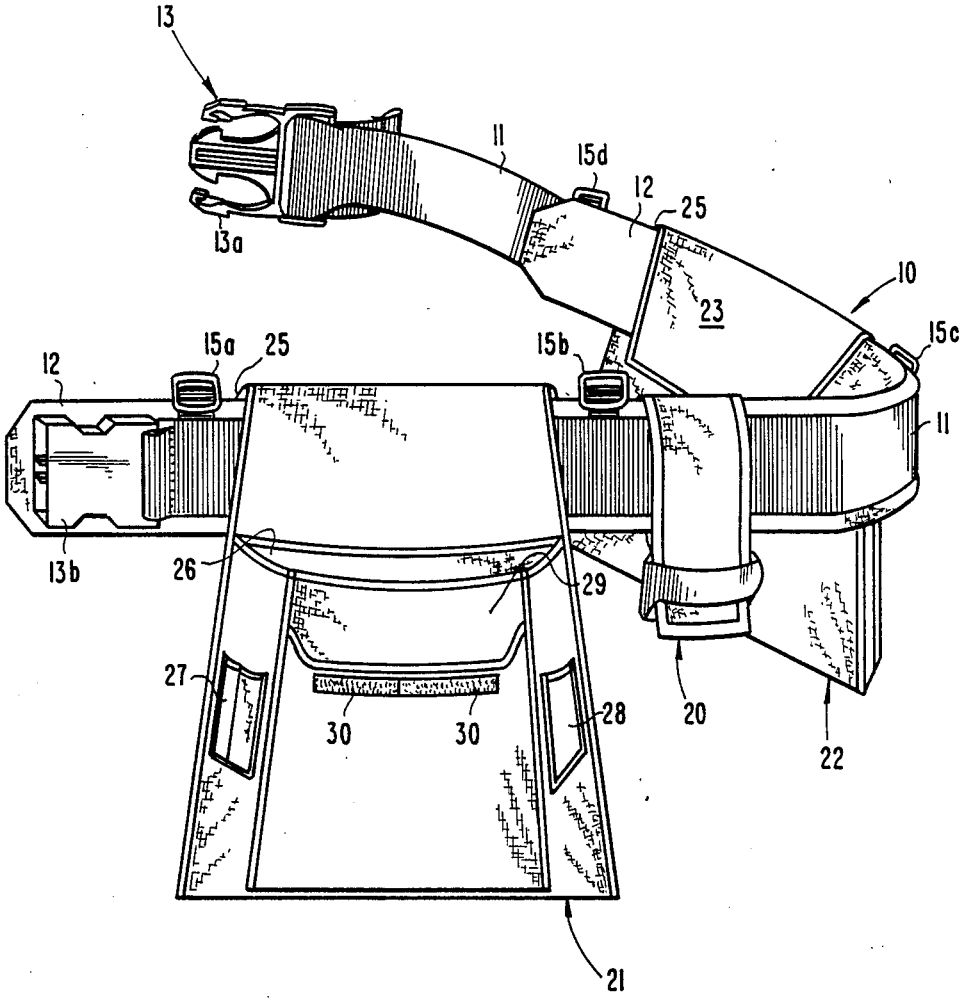
FIG. 1 is a front elevational perspective view of the utility belt of one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, su:h alterations and further modifications in the illustrated devices, and such further applications of the principles of the invention as illustrated therein being contemplated as would normally occur to one skilled in the art to which the invention relates.

In one embodiment of the present invention, illustrated in FIG. 1, a utility belt 10 includes a belt 11 having a buckle assembly 13 attached at its ends. The buckle assembly 13 includes a latch 13*a* through which the belt 11 is slidably threaded to allow for changes in length of the belt. The buckle assembly 13 includes a clasp 13*b* to accept the latch 13*a*, to lock the buckle assembly 13. The end of the belt 11 is suitably fastened to the clasp 13*b*, such as by threading the belt through the clasp and sewing the end of the belt back onto the belt.

The belt 11 is affixed to a padded collar 12, such as by sewing the edges of the belt to the collar material. In this preferred embodiment, the padded collar 12 is about three inches wide so that the utility belt 10 can be comfortably worn around the waist of a wearer, such as a carpenter. Also attached to the belt 11 are a number of buckle rings 15*a*–15*d*, spaced at generally constant intervals around the upper edge of the belt. The buckle rings 15*a*–15*d* can be attached to fabric strips that are sewn to the belt 11 or padded collar 12.

The utility belt 10 of the present embodiment includes a number of components that :an be removably mounted on the belt 11 For instance, the utility belt can include a hammer holster 20 and a pair of flexible pouch arrangements 21 and 22. Each of these removable components includes a loop portion, such as loop portion 25 shown on pouch arrangements 21 and 22, though which the belt 11 can be threaded. The loops 25 are sized to allow the belt to pass therethrough and yet fit tightly enough around the belt 11 to prevent the component from slipping along the length of the belt.

Figure 2:
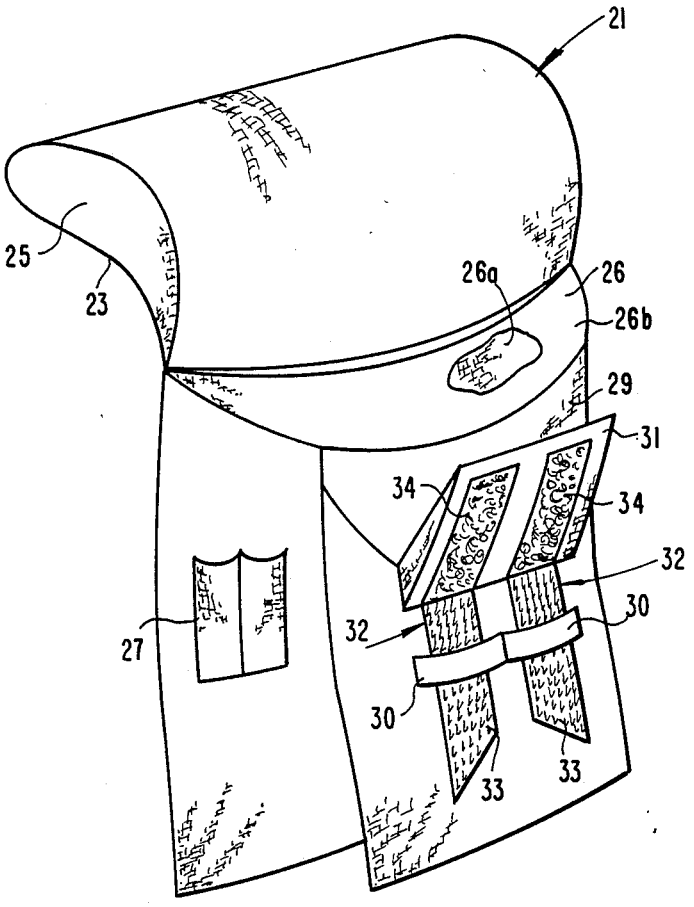
FIG. 2 is an enlarged front elevational perspective view of one detachable component of the utility belt of the present invention.

In the preferred embodiment of the present invention, the loops 25 of the pouch arrangements 21 and 22 are formed by a flap 23 that is a continuous part of the pouch arrangement. The flap 23 can be folded over, as shown in FIG. 2, to form the loop 25. The free end of the flap can be sewn or otherwise affixed to the ba:k of the pouch arrangement 21 or 22.

In one version of the pouch arrangement, such as pouch arrangement 21, the arrangement includes a number of expandable pockets such as pockets 26 and 29 that expand outwardly from the pouch arrangement 21. In addition, specialized pockets can be included, such as pockets 27 to accommodate a pencil or pen, and pocket 28 to accommodate a small tool.

Figure 2A:
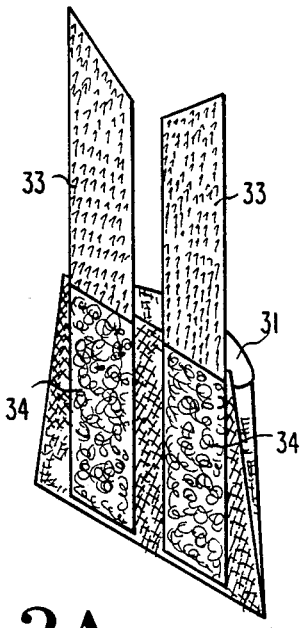
FIG. 2*a* is an enlarged rear elevational perspective view of the detachable pocket shown in FIG. 2.

In an important feature of the present invention, the outermost pocket 29 includes a loop arrangement consisting of a pair of loops 30 affixed to the outside of the pocket 29, shown in more detail in FIG. 2. The loops 30 are attached or sewn on the outside of the pocket 29. An additional detachable pocket 31 can be attached to the pocket 29 by way of the pressure-adhesive, or Velcro, strip arrangements 32. Each strip arrangement 32 includes a pair of Velcro strips 33 and 34 attached to the back of the detachable pocket 31, as shown in FIG. 2*a*. In order to attach the detachable pocket 31 to the pocket 29, the free ends of the strips 33 are passed through the loops 30 on the outside of pocket 29. The detachable pocket 31 is folded down onto the loops 30 and strips 33 so that the Velcro strips 34 contact and pressure adhere to the Velcro strips 33.

Figure 4:
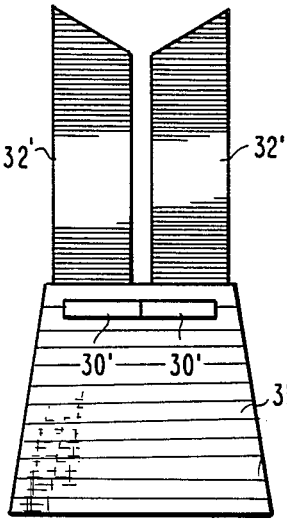
FIG. 4 is an enlarged front view of an additional detachable pocket in one embodiment of the present invention.

The benefit of this Velcro attachment arrangement for the detachable pocket 31 is that new pockets can be added to the utility belt without taking up room along the length of the belt. In practice, an additional detachable pocket 31' could also have a pair of loops 30' similar to the loops 30 and strip arrangements 32' similar to arrangements 32, as shown in FIG. 4, for the attachment of the additional detachable pocket 31' to the outside of the pocket 29 and for attachment of the first detachable pocket 31 to the loops 30' of the additional pocket 31'.

Each of the pockets may be of different colors so that the pockets are color-coded based on the type of articles stored in the pocket. For instance, when the utility belt 10 is used by a carpenter, different size and types of nails can be stored in certain colored pockets. Thus, pocket 31' shown in FIG. 4 may have, for example, the color blue different from the color of pocket 31, which is shown in the color orange in FIG. 2A.

The Velcro strip and loop arrangement of Applicant's invention represents an easy way to attach or detach additional pockets as required by the utility belt user. Unlike utility belts of the prior art, it is not necessary for the user to take the utility belt off in order to remove the additional pocket 31 or any other additional new pocket that may be added to the belt. The use of a pair of loops and Velcro strips adds stability to the detachable pocket 31 when attached to the pocket 29.

In another important feature of the present invention, the pockets are composed of a puncture resistant material. The material has sufficient rigidity so that the pockets generally retain their shape during use. Each pocket is composed of a base cloth that is coated with a material particularly adapted to resist puncture and tearing. For instance, in the preferred embodiment, the pocket 26 is composed of a nylon reinforced base cloth 26A, or scrim, of 20-20 count nylon. The inner surface 40 of the base cloth of pocket 26 is coated with poly-vinyl chloride layer 26*b* to provide the necessary puncture and tear resistance for the present invention. The benefit of this coated inner surface 40 of the pocket 26 is that nails or other sharp articles stored in the pocket cannot poke through the pocket or otherwise tear the pocket, rendering it unusable. In the preferred embodiment, for ease of manufacturing the pocket arrangement 21, the poly-vinyl chloride coated surface 40 extends along the exposed portion of flap 23 when it is folded over to form loop 25.

Each of the pockets of the utility belt 10, such as pockets 27, 29 and 31, can be composed of a similar material. It is understood that the poly-vinyl chloride coated nylon scrim described may be replaced by another pocket material having similar puncture and tear resistance. The substitute material should also have sufficient rigidity to hold the shape of the pocket. One example of a suitable pocket material is sold under the tradename SHELTER RITE ®, model 8207, manufactured by Seaman Corporation Industrial Fabrics Division of Millersburg, Ohio.

Figure 3:
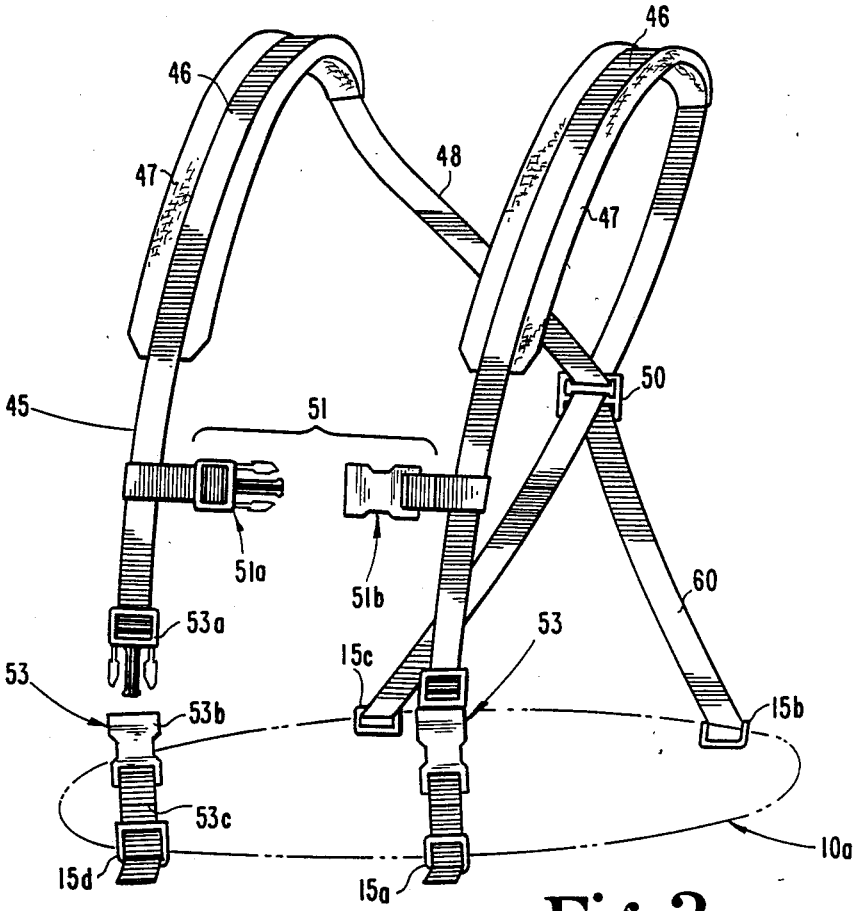
FIG. 3 is a front perspective view of the harness arrangement attachable to the utility belt in a second embodiment of the present invention.

In another embodiment of the present invention, a harness 45 is connected to the utility belt 10 at buckle rings 15*a*–15*d*, as shown in FIG. 3. For clarity, the belt 10 is represented in FIG. 3 by a phantom line 10*a*, it being understood that all the features of the belt 10 as previously described are included in this second embodiment of the present invention. The harness is adapted to be worn about the torso of the wearer to provide additional support to the belt 11. The harness assembly 45 includes a continuous shoulder strap 46 with padding 47 affixed at each shoulder location of the wearer. The shoulder strap 46 passes over each shoulder and along the back of the wearer in a continuous fashion. A portion 48 of the shoulder strap 46 passes through a buckle 50 forming a V-shape on the back of the wearer. The portion 48 of the shoulder strap 46 can slide freely through the eye of the buckle 50 to allow easy adJustment of the harness 45 to account for shifts or variations in the weight of articles being carried in the utility belt 10.

The harness 45 includes a sternum strap 51 spanning the chest of the wearer and attached between the left and right ends of the shoulder strap 46. The sternum strap 51 includes a sternum latch 51*a* and a sternum clasp 51*b* that can be disconnectably interlocked across the chest of the wearer. The sternum strap 51 prevents the shoulder strap 46 from sliding off the shoulders of the wearer.

Figure 3A:
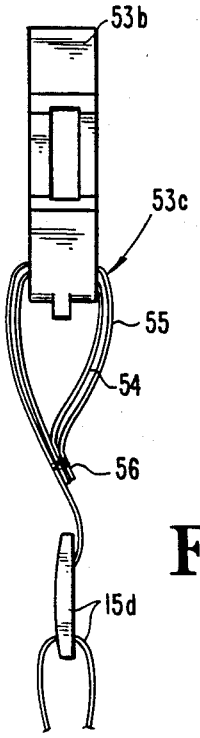
FIG. 3*a* is an enlarged side view of the disconnectable latch assembly of the harness shown in FIG. 3.

The left and right free ends of the shoulder strap 46 terminate in a mounting buckle assembly 53, with the free end being specifically attached to a mounting latch 53*a*, as shown in FIG. 3. The free ends of the strap 46 can either be sewn to the mounting latch 53*a* or, preferably, be slidably engaged through an eye in the mounting latch 53*a* to allow the length of the shoulder strap 46 to be adJusted to accommodate different wearers. Each buckle assembly 53 includes a mounting clasp 53*b* that is removably attached to one of the buckle rings 15*a* or 15*d* by a stretchable portion 53*c*. The stretchable portion 53*c*, as shown in more detail in FIG. 3*a*, includes an inner elastic strip 54 that passes through an eye of the mounting clasp 53*b*. The stretchable portion 53*c* also includes a generally non-elastic strip 55 surrounding the elastic strip 54 and also passing through the eye of the mounting clasp 53*b*. The elastic strip 54 is affixed to the strip 55 at location 56 by sewing the two strips together or by other suitable means. The strip 55 continues beyond location 56 for threading into the buckle ring 15*d* or 15*a*. The addition of the stretchable portion 53*c* allows for some give in the harness 45 to account for shifting of the weight of articles carried by the utility belt. The strip 55 limits the amount of give by the elastic strip 54 to a specific length of stretch so that the harness does not have too much flexibility.

At the back of the wearer, a back strap 60 passes continuously between buckle 15*b* and 15*c* on the belt 10. The back strap 60 passes through the eyes of the buckle 50 so that the back strap 60 is also slidable through the buckle 50, as is the portion 48 of the shoulder strap 46. The left and right free ends of the back strap 60 can be removably threaded through the buckles 15*b* and 15*c*. Thus, the harness 45 of this embodiment is easily attached to the utility belt 10 by simply threading the various stretchable portions and straps 53*c* and 60 onto the several buckle rings 15*a*–15*d*. Moreover, the buckle assemblies at the ends of the shoulder straps and at the sternum strap 51 allows the harness 45 to be easily worn and removed by the wearer of the utility belt.

While the invention has been illustrated and described in detail in the drawings and foregoing description, the same is to be considered as illustrative and not restrictive in character, it being understood that only the preferred embodiment has been shown and described and that all change and modifications that come within the spirit of the invention are desired to be protected.

What is claimed is:

1. A utility belt comprising:

a belt adapted to be worn around the waist of a wearer; and a number of belt components, each of said belt components having means for removably mounting each of said belt components on said belt;

wherein said number of belt components includes a flexible pouch arrangement, said flexible pouch arrangement including;

a first pocket having an outer wall and a loop arrangement on said wall; and a detachable pocket having a pressure adherent strip arrangement affixed thereon and adapted to engage about said loop arrangement for removable attachment of said detachable pocket to said first pocket.

2. The utility belt according to claim 1, wherein said flexible pouch arrangement is composed of a fabric coated with a puncture resistant material having sufficient stiffness to retain the shape of said first pocket when said detachable pocket is attached thereon.

3. The utility belt according to claim 2, wherein said fabric is a nylon mesh and said puncture resistant material is poly-vinyl chloride.

4. The utility belt according to claim 1, further comprising:

a harness removably attached to said belt, said harness being adapted to be worn around the torso of the wearer for supporting said belt.

5. The utility belt according to claim 4, wherein said harness includes:

a buckle situated adjacent the back of the wearer when said harness is worn about the torso of the wearer;

a continuous shoulder strap slidably extending through said buckle and having left and right free ends;

a continuous back strap slidably extending through said buckle; and a disconnectable sternum strap affixed between said left and right free ends of said shoulder strap and arranged to be worn across the chest of the wearer when said harness is around the torso of the wearer; and means for removably attaching said harness to said belt including;

a pair of disconnectable buckle assemblies affixed between said belt and a corresponding one of said left and right free ends; and means for adjustably attaching said back strap to said belt.

6. The utility belt according to claim 5, wherein:

each of said pair of disconnectable buckle assemblies includes;

a latch engaged on a corresponding one of said left and right free ends;

a clasp adapted to receive said latch in releasable locking engagement; and means for attaching said clasp to said belt having a stretchable portion between said clasp and said belt.

7. The utility belt according to claim 6, wherein:

said stretchable portion includes;

an inner elastic strip affixed between said clasp and said belt; and an outer generally inelastic strip surrounding said inner elastic strip and affixed between said clasp and said belt to limit the elastic expansion of said inner elastic strip.

* * * * *